United States Patent [19]

Ngai

[11] 4,189,155

[45] Feb. 19, 1980

[54] RECORD PLAYER

[76] Inventor: Mun-Hay Ngai, 130-132 Argyle St., 3/Fl., Flat C, Kowloon, Hong Kong

[21] Appl. No.: 931,371

[22] Filed: Aug. 7, 1978

[30] Foreign Application Priority Data

Mar. 3, 1978 [GB] United Kingdom ..... 8625/78

[51] Int. Cl.[2] ..... A63H 3/33; G11B 25/04

[52] U.S. Cl. ..... 274/1 A; 274/9 R

[58] Field of Search ..... 274/9 R, 9 B, 9 C, 1 A

[56] References Cited

U.S. PATENT DOCUMENTS

| | | | |
|---|---|---|---|
| 3,633,923 | 1/1972 | Watanabe | 274/1 A |
| 3,823,946 | 7/1974 | Nakajima | 274/1 A |
| 4,107,489 | 8/1978 | Watanabe | 274/9R |
| 4,118,037 | 10/1978 | Ngai | 274/1 A |

*Primary Examiner*—Steven L. Stephan

[57] ABSTRACT

A record player suitable for a toy and comprising a container, a cover therefor, a turntable rotatably mounted on said cover, an electric motor in said container for driving the turntable, a speaker in said container, first spring means pivotably biasing the speaker towards the turntable, a tone arm having a stylus, second spring means biasing the tone arm away from the turntable and radially outwardly thereof, said tone arm being movable with said speaker towards the turntable against the bias of said second spring means for engaging a record on the turntable, switch means operable by said tone arm as the tone arm moves towards the center of the turntable to break a circuit supplying driving current to the motor, operating means for pivoting the speaker away from the turntable against the bias of the first spring means so as to allow the second spring means to move the tone arm away from and radially outwardly of the turntable.

12 Claims, 13 Drawing Figures

RECORD PLAYER

The present invention relates to a record player, particularly but not exclusively for dolls.

The invention provides a record player suitable for a toy and comprising a container with a cover carrying a turntable rotatable by means of an electric motor in the container, a speaker movable about a pivot towards the turntable under the bias of a first spring means, a tone arm having a stylus and being movable with the speaker towards the turntable against the bias of second spring means so as to engage a record in use on the turntable, the second spring means biasing the tone arm radially outwardly of the turntable, switch means operable by the tone arm as the tone arm moves towards the centre of the turntable to break a circuit supplying driving current to the motor, operating means for pivoting the speaker away from the turntable against the bias of the first spring means so as to allow the second spring means to move the tone arm away from and radially outwardly of the turntable.

Preferably, the switch means comprises a lever having a first and second arm and being pivotable by the tone arm, on contact of the tone arm with the first lever arm as the tone arm approaches the centre of the turntable, so as to cause the second lever arm to move a movable metal contact away from a fixed metal contact and break the circuit to the motor.

Preferably, the first spring means comprises a leaf spring the bias of which is adjustable.

Alternatively, the first spring means is a helical compression spring.

Preferably, the motor has a spindle biased into driving contact with the periphery of the turntable.

Preferably, the bias of the spindle against the turntable periphery is caused by a spring.

Preferably, the bias of the spring is adjustable.

Preferably, the spring is a metal wire urging against the motor, which is pivotably mounted in the container.

Preferably, the wire engages a notch in a rotatable spindle for adjustment of the spring bias.

Preferably, the pressure of the stylus on the record decreases as the tone arm moves towards the centre of the turntable so that the speed of the record is substantially constant.

Preferably, the speaker is mounted in a pivotable speaker frame which has a lug against which the first spring means acts, and an arm connected to the apex of the speaker, said arm moving the tone arm towards the turntable on pivoting of the speaker frame by the first spring means towards the turntable.

Preferably, the speaker comprises a diaphragm tapering outwardly from the speaker apex, the speaker periphery being connected to a ring connected to the speaker frame.

An embodiment of the invention will now be described with reference to the accompanying drawings, wherein.

Figure 1:
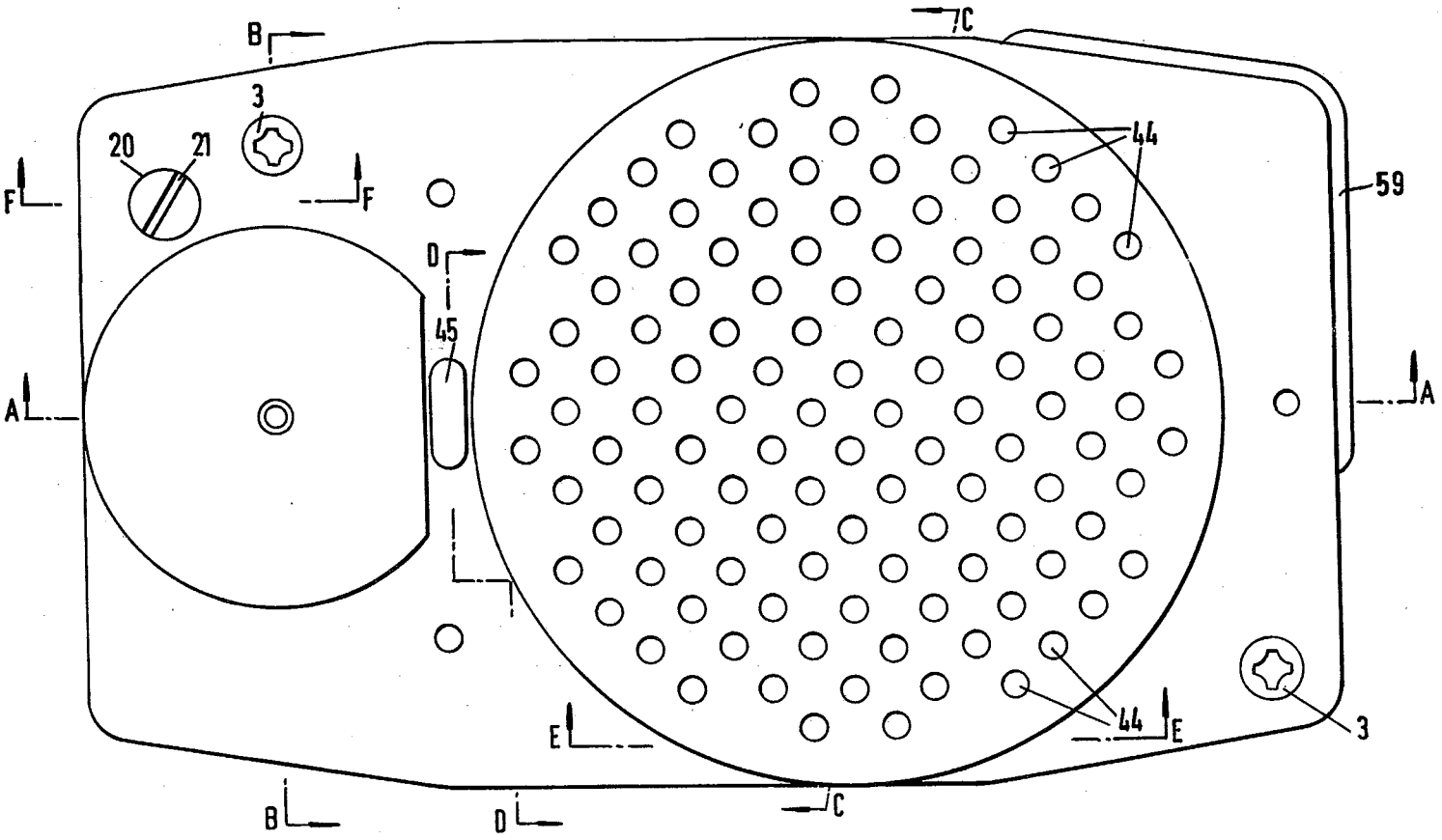
FIG. 1 is a plan view of a record player in accordance with the invention.

In the drawings, a record player is housed in a container having a top 1 and a base 2 connected by means of screws 3. A base cover is formed from two cover parts 4 and 5. The cover part 4 is fixed to the base 2 by screws 6, and the cover part 5 has a tongue 7 at one edge engaging a hook 8 of the base 2, and has two tongues 7' at the opposite edge 9 held by the cover 4.

An electric motor 10 is mounted in a carrier 11 provided with trunnions 12 pivotably mounted on trunnion bearings 13 integral with the base 2. The motor 10 has a spindle 14 extending through an aperture of the base 2. The spindle 14 carries a friction sleeve 15, which in operation drives a turntable 16 rotatably mounted on a spindle 17 fixed to the cover part 5. The motor 10 is biased by a spring wire 18 to ensure frictional contact between the sleeve 15 and the peripheral rim of the turntable 16. The wire 18 passes through a notch 19 and bears against a continuous cam surface in a spindle 20 mounted in aligned apertures in the top 1, the base 2 and the cover part 4. The cam surface when viewed in the axial direction of the spindle 20 is circular and the axis of the spindle 20 eccentric with respect to the centre of the circular cam surface. Both ends of the spindle 20 have a slot 21, so that the spindle 20 may be turned by a screwdriver to change the pressure exerted by the spindle 14 via the sleeve 15 on the rim of the turntable 16. A rubber washer 22 on the spindle 20 and bearing against the underside of the top 1 prevents unintentional rotation of the spindle 20.

The turntable 16 has a central boss 23 with a central hole accommodating the spindle 17. The boss 23, and hence the turntable 16, is held on the spindle 17 by a circlip 17'. The turntable 16 also has a plurality of circumferentially-spaced, resiliently-deformable tangs 24. The turntable 16 carries a record 25 having a central aperture firmly engaged by the resilient tangs 24.

A speaker diaphragm 26 is supported in a speaker frame 27 via a diaphragm ring 28 glued to the periphery of the speaker diaphragm 26.

Figure 7:
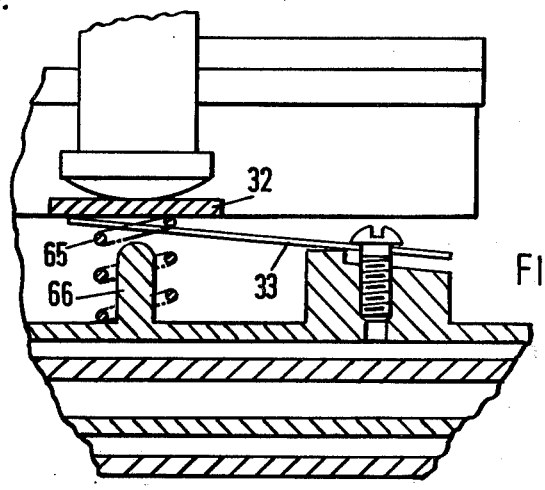
FIG. 7 is a section taken along the line D—D of FIG. 1.

The speaker frame 27 has two trunnions 29 pivotably supported in trunnion bearings 30 attached to the base 2. The speaker frame 27 has an integral support arm 31 connected to the apex of the speaker diaphragm 26, and an integral lug 32 against the underside of which a leaf spring 33 is biased. The bias of the spring 33 may be adjusted by means of an adjusting screw 34 (FIG. 7) connecting the spring 33 to the base 2. The spring 33 urges the lug 32 upwardly away from the turntable 16 thus pivoting the speaker frame 27 and the support arm 31 downwardly towards the turntable 16 to contact a pip 35 on the top of a tone arm 36.

Figure 6:
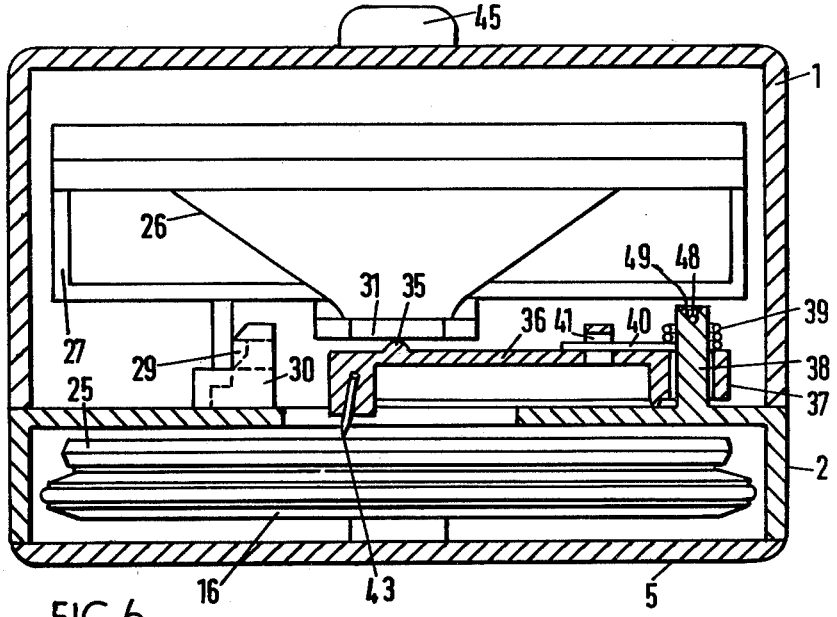
FIG. 6 is a section taken along the line C—C of FIG. 1.

As can be seen from FIG. 6, the tone arm 36 has an integral collar 37 at one end thereof by means of which the arm 36 is pivotably mounted on an upstanding pillar 38 integral with the base 2. The tone arm 36 is urged radially outwardly of the turntable 16 by means of a coil spring 39 having a tangential arm at each end thereof. One arm (not shown) bears against a pillar (not shown) on the base 2, and the other arm 40 bears against an abutment 41, which may form part of a closed frame, on the upper surface of the tone arm 36 thus biasing the arm 36 in the radially outwards direction.

The lower end of the collar 37, i.e. the end adjacent the base 2, carries a rib 42. The spring 39 is compressed, and thus urges the collar 37 downwardly towards the base 2. The tone arm 36 is thus pivoted upwardly away from the turntable 16 about the rib 42. The end of the tone arm 36 remote from the collar 37 carries a needle or stylus 43 for contacting the record 25. The pivotal movement of the speaker frame 27 towards the turntable 16 caused by the spring 33, ensures that when the stylus 43 contacts the record 25, the pip 35 contacts the support arm 31 attached to the apex of the speaker diaphragm 26. Thus, sound vibrations picked up from the record 25 by the stylus 43 are transmitted via the tone arm 36, the pip 35 and the support arm 31 to the speaker diaphragm 26 and emitted as sound, which escapes from the top 1 through the holes 44.

The speaker frame 27 may be pivoted upwardly away from the turntable 16 against the bias of the spring 33 by means of a button 45 slidably mounted in a guide aperture 46 (FIG. 3) in the top 1 and resting on the lug 32. This allows the tone arm 36 to pivot upwardly away from the turntable 16 about the rib 42 under the action of the spring 39. Once the stylus is freed from the record the tone arm 36 is swung radially outwardly of the turntable 16 by means of the spring arm 40.

Figure 8:
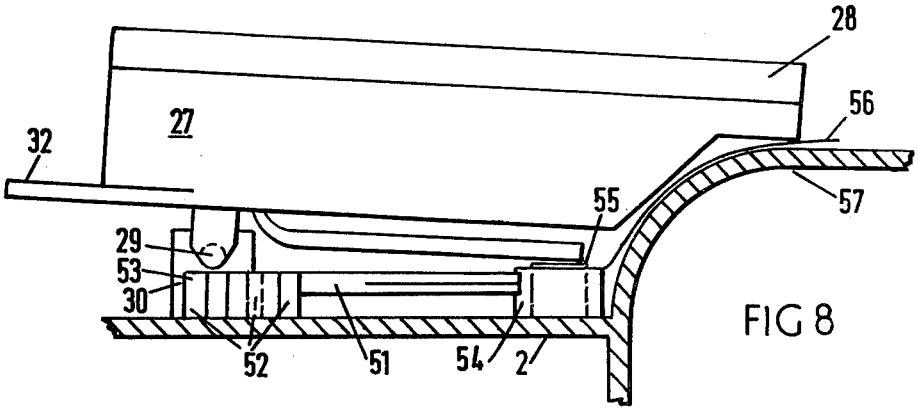
FIG. 8 is a section taken along the line E—E of FIG. 1.
Figure 9:
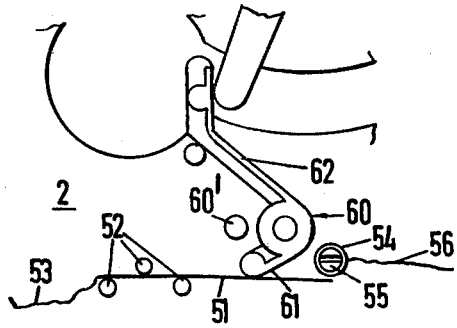
FIG. 9 is a plan view of the switch mechanism.

A first terminal (not shown) of the electric motor 10 is connected to a first battery terminal 47 (FIG. 2) directly by means of a conducting wire 48 (FIG. 6). The wire 48 passes through an aperture 49 at the top of the pillar 38 and thus holds the spring 39 on the pillar 38. A second terminal of the electric motor 10 is connected to a second battery terminal 50 (FIG. 2) via a switch mechanism (FIGS. 8 and 9).

The switch mechanism comprises a metal strip 51 held at one end between three short pillars 52 integral with the base 2 and is connected to a wire 53 leading to the second terminal (not shown) of the electric motor 10. The other end of the metal strip 51 bears resiliently against a metal stud or eyelet 54 mounted on a pillar 55 integral with the base 2. The metal stud 54 is connected to a wire 56 leading to a second terminal 50 (FIG. 2) of the battery. The battery terminals 47 and 50 are accommodated at opposite ends of a battery housing 57 arranged in the base 2 and containing a battery 58 (FIG. 3). The battery housing is provided with a pivotable lid 59.

A lever 60 (FIG. 9) having arms 61 and 62 is pivotably mounted on the base 2. The arm 61 lies between the metal strip 51 and a stop 60' on the base 2. Movement of the lever 60 in an anti-clockwise direction causes the arm 61 to move the metal strip 51 away from the metal stud 54 and thus break the electric circuit to the motor 10.

As shown in FIG. 3, the playing track of the record 25 terminates in a continuous groove 25*a* which is deeper than the playing track. The groove 25*a* has a radially outer bank downwardly inclined towards the spindle and a radially inner bank normal to the surface of the record. Alternatively, the groove 25*a* may be replaced by a continuous depression having a bank, which is inclined downwardly towards the spindle only, at its radially outer edge, the radially inner edge of the depression terminating at the central hole in the record.

The record player operates as follows: Current from the battery 58 drives the motor 10 which rotates the turntable 16. The stylus 43 engaged in the playing groove of the record 25 moves radially inwards of the turntable 16 until it slides down the inclined outer bank of the groove 25*a*, during which movement the tone arm 36 contacts the arm 62 of the lever 60 (FIG. 9) and pivots the lever so that the arm 61 forces the metal strip 51 away from the metal stud 55, thus breaking the circuit and stopping the motor 10. The stylus remains in the groove 25*a*. To replay the record, the button 45 is depressed, thus pivoting the speaker frame away from the turntable 25 and hence freeing the tone arm 36, which can now move away from the turntable 25 under the action of the spring 39, i.e. out of the groove. As soon as the stylus 43 is released from the groove the spring 39 moves the tone arm 36 radially outwards to the outer edge of the record 25. When the button 45 is released the speaker frame 27 is pivoted again towards the turntable 16 by the spring 33 until the stylus 43 again enters the playing groove of the record 25.

As will be understood from the above, the rest state of the record player is when the stylus 43 is in the groove 25*a* and the switch mechanism (FIG. 9) breaks the circuit to the motor 10.

The speed of the record may be adjusted very simply merely by inserting a screw driver in the slot 21 and turning the spindle 20 to increase or decrease the contact pressure between the sleeve 15 and the turntable periphery.

Figure 10:
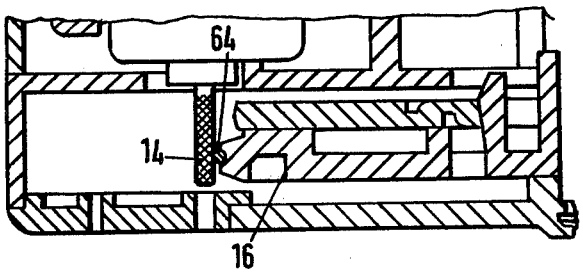
FIG. 10 is a section similar to part of FIG. 3 showing a modification.

Various modifications may be made to the above-described record player. Thus, the sleeve on the spindle 14 of the motor may be removed, and the periphery of the turntable 16 may be provided with a groove containing a ring 64 (FIG. 10), e.g. of rubber. The spindle 14, which may be roughened, e.g. serrated, is urged against the rubber ring by the spring wire 18 so that a simple non-slip drive results. This is particularly useful when silicon oil used to lubricate the record to reduce needle damage leaks down the periphery of the turntable 16. Alternatively, the sleeve may be formed of metal (e.g. copper) and roughened which sleeve contacts the ring 64.

As described in our co-pending application No. 591/177 the groove 25*a* reduces the risk of the stylus 43 skidding across the record unintentionally.

The leaf spring 33 may be replaced by a compression coil spring 65 (FIGS. 3 and 7) mounted on a pillar 66 integral with the base 2.

Figure 2:
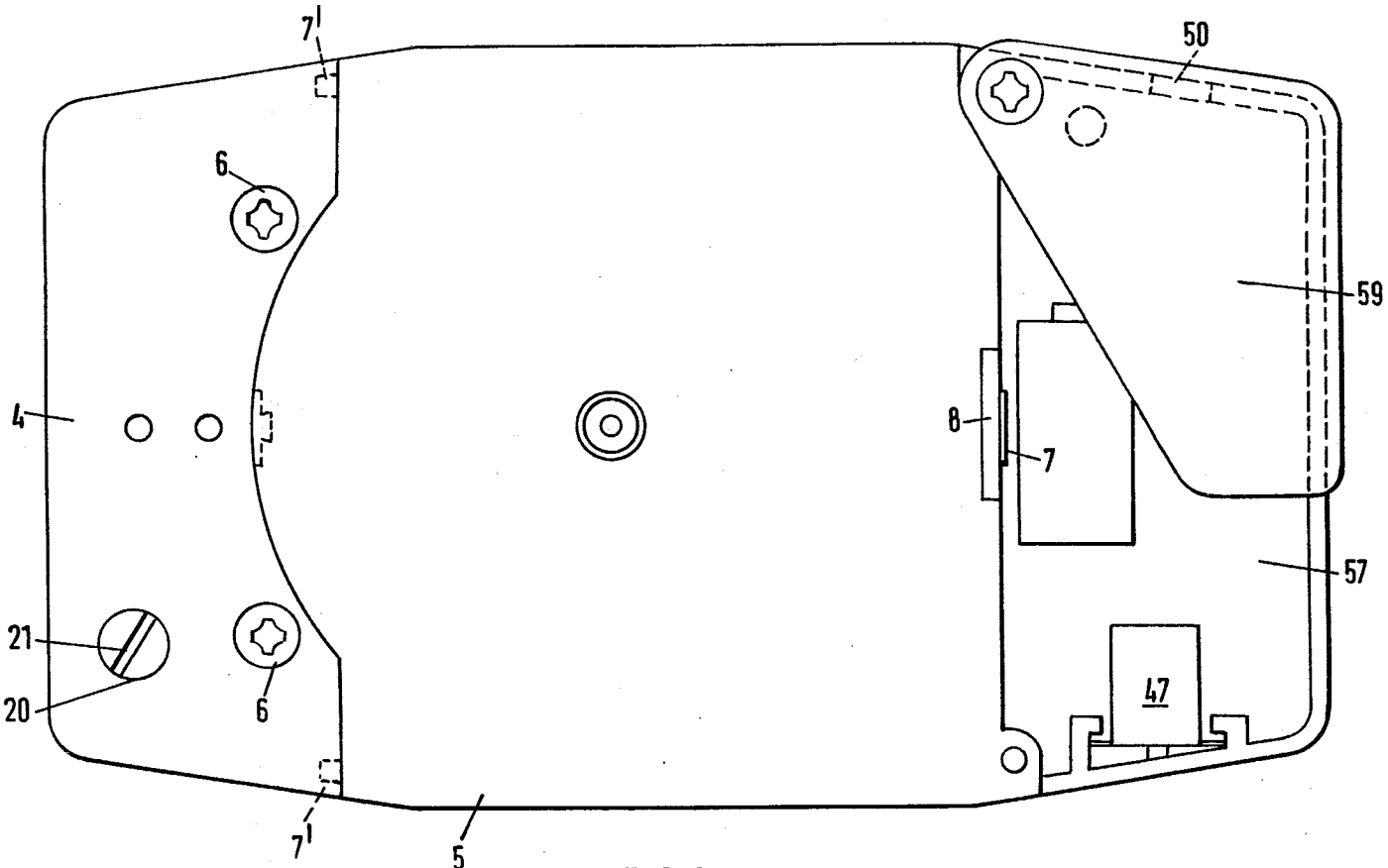
FIG. 2 is an underview of the record player of FIG. 1.
Figure 3:
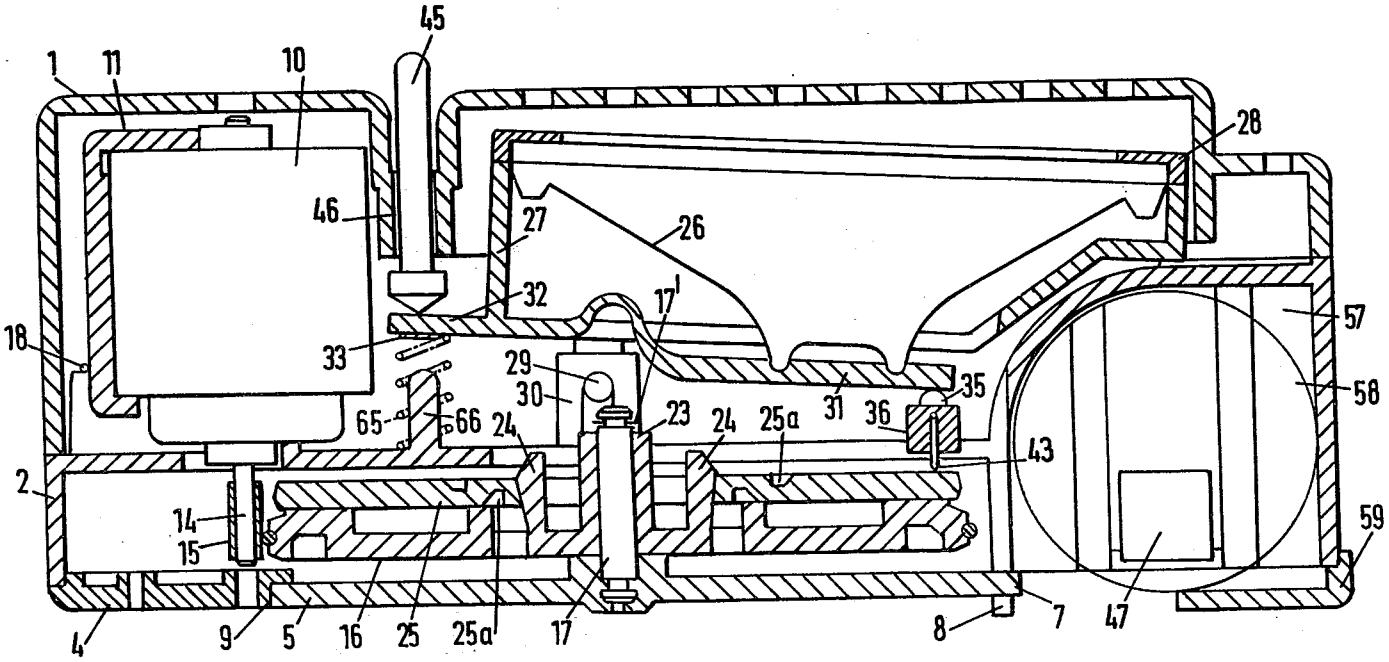
FIG. 3 is a section taken along the line A—A of FIG. 1.
Figure 4:
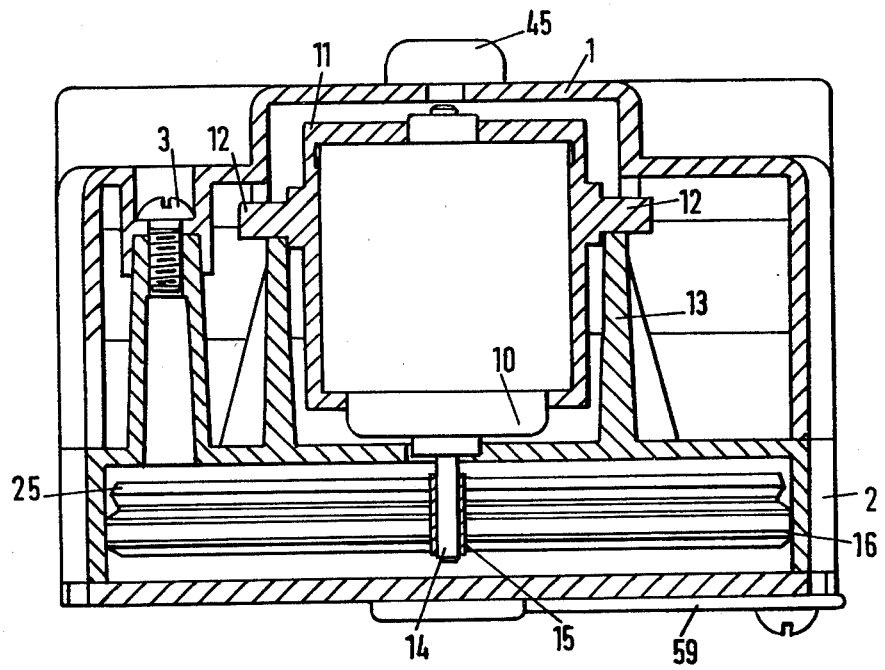
FIG. 4 is a section taken along the line B—B of FIG. 1.
Figure 5:
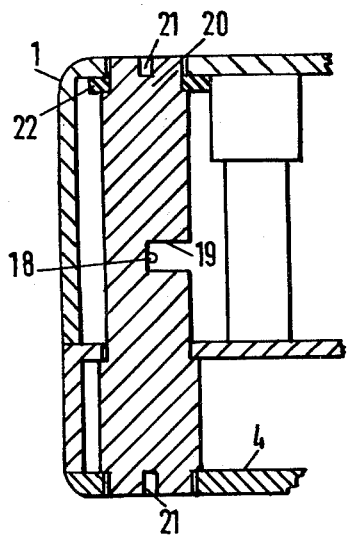
FIG. 5 is a section taken along the line F—F of FIG. 1.
Figure 11:
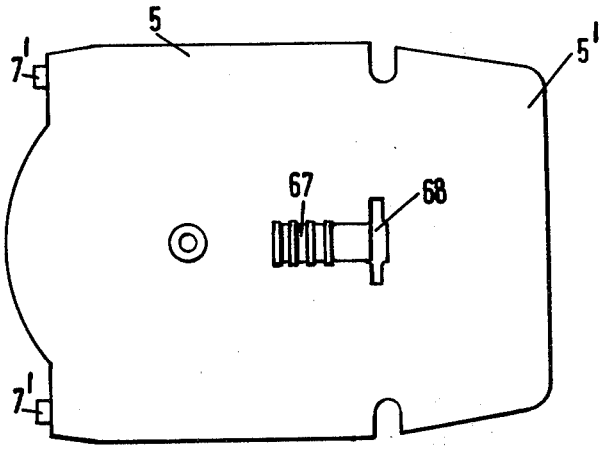
FIG. 11 is a view similar to FIG. 2 of a detachable cover.

As can be seen from FIG. 11, the cover part 5 supporting the turntable 16 may be formed with a clip 67 slidably movable in an aperture 68 for engagement and disengagement with the loop 8 (FIG. 2). In this way the cover part 5 may be easily detached for changing or turning over the record 25. If desired, the cover part 5 may be extended at 5' as shown in FIG. 11 to cover the battery housing 57.

Figure 12:
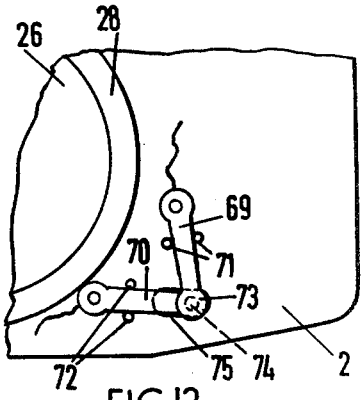
FIG. 12 is a plan view of circuit-breaking means for use with a detachable cover.

If the cover part 5 is detachable, then means are provided for breaking the circuit to the motor 10 when the cover part 5 is detached such circuit-breaking means may comprise (FIG. 12) two spring metal tongues 69, 70 attached to the base 2 and positioned between pairs of pegs 71, 72 so that normally there is a gap between their ends 73. When the cover part 5 is in place, a projection 74 projects through a hole 75 in the base 2 and urges the end of a lower tongue 70 into engagement with the end of the upper tongue 69, thus completing the circuit. Conversely, when the cover part 5 is removed the circuit to the motor is broken.

Known record players for toys tend to be complicated in construction, expensive and unreliable. Furthermore, if expense is spared, the sound reproduction is most unsatisfactory.

An object of the invention is to provide a record player for a toy which is constructionally simple and cheap which is reliable and which has satisfactory sound production.

Figure 13:
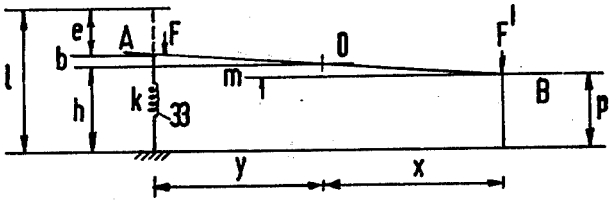
FIG. 13 is a diagrammatic side view illustrating the forces on a lever equivalent to the speaker frame of FIG. 3.

It is particularly advantageous if the stylus pressure decreases as the stylus 43 travels towards the centre of the record 25. This is achieved by the choice of suitable parameters as follows:

Referring to FIG. 13, l is the length of the spring when uncompressed;
h is the height of the pivot (i.e. of trunnions 29);
e is the compression of the spring;
b is the length of the spring above the pivot O;
m is the height of the pivot O above the stylus tip;
F is the force exerted by the spring, and
F′ is the force on the tone arm 36.

A simple lever AB supported at point O represents the speaker frame 27. The pressure provided by the leaf spring 33 is very similar to that provided by a spring with a spring constant k.

By Hooke's Law $F=Ke$, where e is the compression of the spring Taking moments about O, we obtain $$Fy=F'x$$

$$\text{or } key=F'x.$$

From FIG. 11, $e=1-b-h$ $$\therefore ky(1-b-h)=F'x \quad (1)$$

Differentiating equation (1) with respect to x, we have $$-ky\frac{db}{dx}=F'+x\frac{dF'}{dx} \quad (2)$$

From the geometrical relationship in FIG. 1, we have $$\frac{b}{y}=\frac{m}{x} \longrightarrow \begin{cases} b=\frac{my}{x} \text{ and} & (3) \\ \frac{db}{dx}=\frac{my}{x^2} & (4) \end{cases}$$

Substituting equation (4) into equation (2) and also equation (1) into equation (2) we get $$\frac{mky^2}{x^2}=\frac{ky(1-b-h)}{x}+x\frac{dF'}{dx} \text{ or} \quad (5)$$

$$\frac{mky^2}{x^3}=\frac{ky(1-b-h)}{x^2}+\frac{dF'}{dx}$$

Substituting equation (3) into equation (5) we get $$\frac{kyb}{x^2}-\frac{ky(1-b-h)}{x^2}=\frac{dF'}{dx}$$

or $$\frac{dF'}{dx}=\frac{ky}{x^2}(2b+h-1)$$

But b=my/x, $$\therefore \frac{dF'}{dx}=\frac{ky}{x^2}\left[\frac{2my}{x}+h-1\right]$$

or $$\frac{dF'}{dx}=\frac{ky}{x^3}[2my-(1-h)x]$$

$$\therefore \text{for } 2my>(1-h)x$$

i.e. when $x<2my/(1-h)$, F′ will increase with an increase x. Since the magnitude of pressure (p) on the tone arm 36 is directly proportional to that of F′, the relationship between F′ and x applies to that between P and x. Thus, if the initial distance of the tone arm 36 from the pivot axis of the trunnions 29 is equal to or less than the value of $2my/(1-h)$, then the pressure on the stylus will decrease as the tone arm 36 moves towards the centre of the record 25.

I claim:

1. A record player suitable for a toy and comprising:
a container;
a cover therefore;
a rotably mounted turntable;
an electric motor including a driving spindle for driving the turntable;
a speaker in said container;
a tone arm having a stylus;
said tone arm being movable with said speaker toward the turntable and including means for causing said stylus to engage a record on the turntable;
a circuit supplying driving current to the motor, including switch means operable by said tone arm as the tone arm moves toward the center of the turntable to interrupt the driving current;
means for pivotly mounting the motor in the container;
a metal spring wire mounted so as to bias said driving spindle into driving contact with the periphery of the turntable; and
an adjustment spindle rotatably mounted in said container and having a notch engaged by said metal wire so that rotation of said adjustment spindle alters the bias of the drive spindle against the periphery of the turntable to alter the speed of the turntable.

2. A record player according to claim 1, wherein said switch means comprises a fixed metal contact arranged in said circuit of the motor, a lever having a first lever arm and a second lever arm shorter than said first lever arm and being pivotable by the tone arm on contact of the tone arm with said first lever arm as the tone arm approaches the centre of the turntable, so as to cause the second lever arm to move said movable metal contact away from said fixed metal contact and break said circuit to the motor.

3. A record player as claimed in claim 2, wherein the record player further comprises at least one record having a playing track terminating in a continuous depression which is deeper than the playing track, a bank at the radially outer edge of the depression being downwardly inclined towards the spindle such that, in use, when the stylus reaches said depression it slidably moves down the inclined bank, during which movement the tone arm pivots said first lever arm to cause the second lever arm to move the movable metal contact away from the fixed metal contact and break the circuit of the motor.

4. A record player as claimed in claim 3, wherein the depression comprises a continuous groove having a radially outer bank and a radially inner bank, the outer bank being downwardly inclined towards the spindle and the inner bank being normal to the plane of the record.

5. A record player as claimed in claim 1, wherein the wire engages a continuous cam surface of the adjustment spindle.

6. A record player as claimed in claim 5, wherein the cam is mounted for angular movement about an axis, the cam surface being circular when viewed in an axial direction and the axis being eccentric with respect to the centre of the cam surface.

7. A record player as claimed in claim 5, wherein the cam is mounted for angular movement about an axis normal to the longitudinal axis of the wire.

8. A record player according to claim 1, further comprising a pivotable speaker frame having a lug against which a first spring means acts and an arm, the apex of the speaker being connected to said arm, so that said arm moves the tone arm towards the turntable on pivoting of said speaker frame by said first spring means towards the turntable.

9. A record player according to claim 8, wherein the speaker comprises a diaphragm tapering outwardly from the speaker apex to a periphery, a ring connecting said periphery to the speaker frame.

10. A record player according to claim 1, wherein said cover is detachably mounted on said container for changing or turning a record.

11. A record player according to claim 1, further comprising means for breaking the electric circuit to the motor on detachment of the cover, said means comprising two metal members biased away from each other to break the circuit, a projection on said cover holding the metal members in contact when the cover is in place on the container.

12. A record player according to claims 1, 5, 6, or 7 further comprising a resilient ring mounted in a groove in the periphery of the turntable and located such that the driving spindle bears against said resilient ring.

* * * * *